US009932049B2

(12) United States Patent
Kato et al.

(10) Patent No.: US 9,932,049 B2
(45) Date of Patent: Apr. 3, 2018

(54) RAILCAR BODYSHELL

(71) Applicant: KAWASAKI JUKOGYO KABUSHIKI KAISHA, Kobe-shi, Hyogo (JP)

(72) Inventors: Eiichi Kato, Kobe (JP); Chihiro Okayama, Kobe (JP); Toshiyuki Hirashima, Kobe (JP); Akihiko Tada, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 173 days.

(21) Appl. No.: 14/770,308

(22) PCT Filed: Feb. 20, 2014

(86) PCT No.: PCT/JP2014/000875

§ 371 (c)(1),
(2) Date: Aug. 25, 2015

(87) PCT Pub. No.: WO2014/129190

PCT Pub. Date: Aug. 28, 2014

(65) Prior Publication Data

US 2016/0001789 A1 Jan. 7, 2016

(30) Foreign Application Priority Data

Feb. 25, 2013 (JP) ..... 2013-034506

(51) Int. Cl.
*B61D 17/04* (2006.01)
*B61D 17/08* (2006.01)
(Continued)

(52) U.S. Cl.
CPC ..... *B61D 17/045* (2013.01); *B61D 17/08* (2013.01); *B61D 17/10* (2013.01); *B61D 17/12* (2013.01)

(58) Field of Classification Search
CPC ..... B61D 17/00; B61D 17/04; B61D 17/043; B61D 17/045; B61D 17/06; B61D 17/08; B61D 17/10; B61D 17/12
See application file for complete search history.

(56) References Cited

U.S. PATENT DOCUMENTS 5,797,646 A 8/1998 Jeunehomme et al.
2007/0284913 A1* 12/2007 Ehrlich ..... B62D 33/046 296/186.1

FOREIGN PATENT DOCUMENTS

EP 1000841 A1 5/2000
EP 1353832 B1 12/2007
(Continued)

OTHER PUBLICATIONS

May 27, 2014 International Search Report issued in International Patent Application No. PCT/JP2014/000875.

*Primary Examiner* — Robert J McCarry, Jr.
(74) *Attorney, Agent, or Firm* — Oliff PLC

(57) ABSTRACT

A railcar bodyshell includes: a plurality of modules into which at least one of a floor portion, side portion, and roof portion of the bodyshell is divided in a car longitudinal direction; and an elongated member extending in the car longitudinal direction, the plurality of modules being attached to the elongated member. The elongated member includes a groove portion for fixing the plurality of modules to the elongated member the groove portion extending in the car longitudinal direction.

8 Claims, 8 Drawing Sheets

(51) Int. Cl.
*B61D 17/10* (2006.01)
*B61D 17/12* (2006.01)

(56) References Cited

FOREIGN PATENT DOCUMENTS

| | | | |
|---|---|---|---|
| EP | 2172382 | A1 | 4/2010 |
| JP | H1-145259 | A | 6/1989 |
| JP | H09-86407 | A | 3/1997 |
| JP | H09-109881 | A | 4/1997 |
| JP | 2003-191842 | A | 7/2003 |

* cited by examiner

RAILCAR BODYSHELL

TECHNICAL FIELD

The present invention relates to a railcar bodyshell constituted by a plurality of modules.

BACKGROUND ART

When producing a bodyshell of a railcar, typically, metal panels are joined to one another by welding. However, since the metal panel is easily distorted by the welding, a high degree of welding skill is required. In addition, since the welding is accompanied by electricity and heat, the metal panel to which fittings are attached in advance cannot be subjected to the welding. Here, proposed is a module construction method of coupling a plurality of modules to one another by fastening members or the like to assemble a bodyshell, each of the modules being produced in advance to have a predetermined configuration (see PTLs 1 to 6, for example).

CITATION LIST

Patent Literature

PTL 1: European Patent No. 1353832

PTL 2: U.S. Pat. No. 5,797,646

PTL 3: Japanese Laid-Open Patent Application Publication No. 2003-191842

PTL 4: Japanese Laid-Open Patent Application Publication No. 1-145259

PTL 5: Japanese Laid-Open Patent Application Publication No. 9-86407

PTL 6: Japanese Laid-Open Patent Application Publication No. 9-109881

SUMMARY OF INVENTION

Technical Problem

However, since the number of modules is large when performing assembling work of the bodyshell by the module construction method, the positioning of each module is required every time work of coupling the module is performed. Thus, the work is troublesome.

An object of the present invention is to facilitate the assembling work of the railcar bodyshell by the module construction method.

Solution to Problem

A railcar bodyshell according to the present invention includes: a plurality of modules into which at least one of a floor portion, side portion, and roof portion of the bodyshell is divided in a car longitudinal direction; and an elongated member extending in the car longitudinal direction, the plurality of modules being attached to the elongated member, the elongated member including a groove portion for fixing the plurality of modules to the elongated member, the groove portion extending in the car longitudinal direction.

According to the above configuration, the elongated member includes the groove portion extending in the car longitudinal direction. With this, the plurality of modules are easily positioned relative to the elongated member in a direction perpendicular to the car longitudinal direction, and the modules can be easily fixed to the elongated member with a high degree of accuracy.

Advantageous Effects of Invention

As is clear from the above explanations, according to the present invention, the modules constituting the bodyshell of the railcar can be easily fixed to the elongated member with a high degree of accuracy.

DESCRIPTION OF EMBODIMENTS

Hereinafter, embodiments will be explained in reference to the drawings.

First Embodiment

Figure 1:
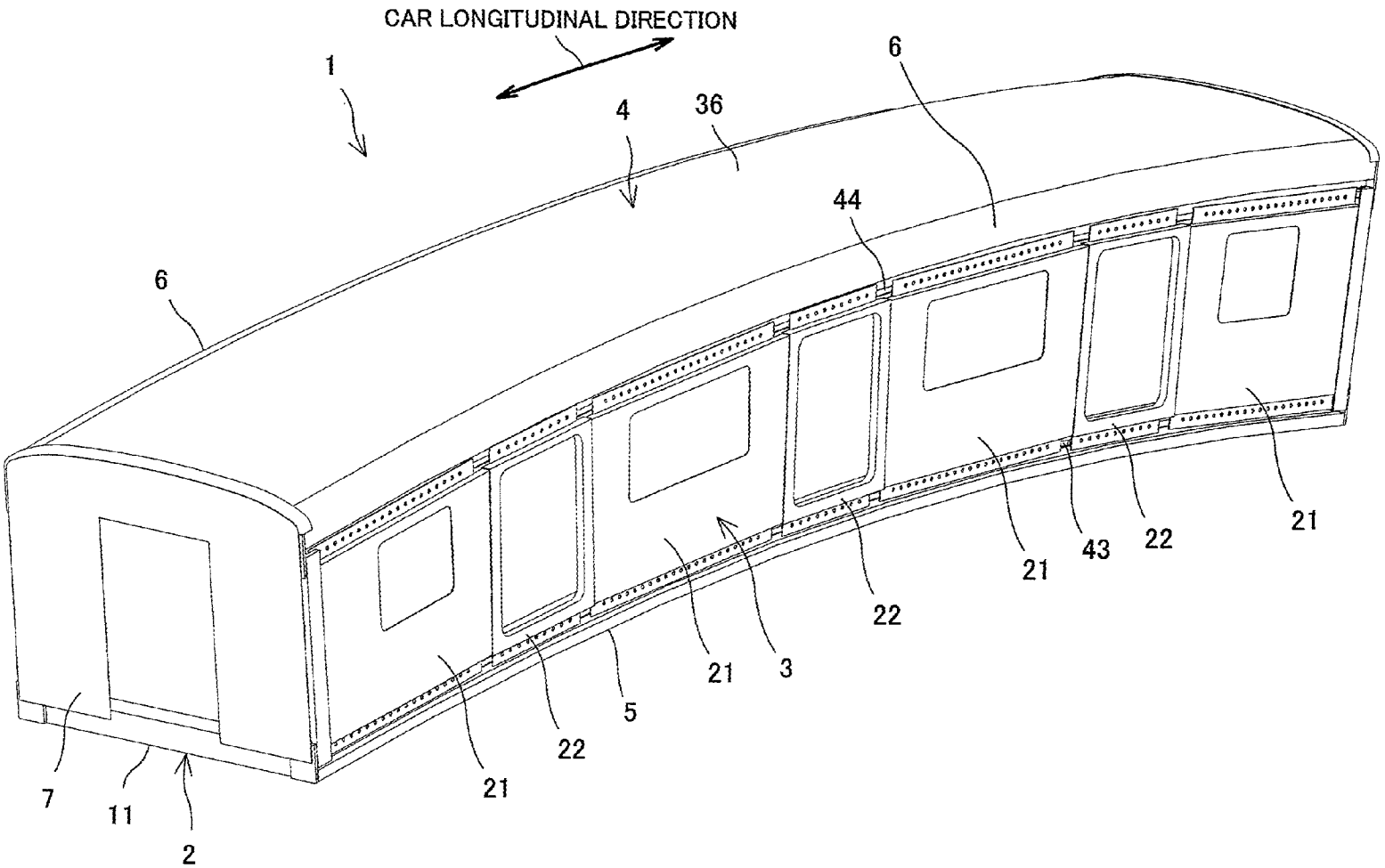
FIG. 1 is a perspective view showing a railcar bodyshell according to a first embodiment.
Figure 2:
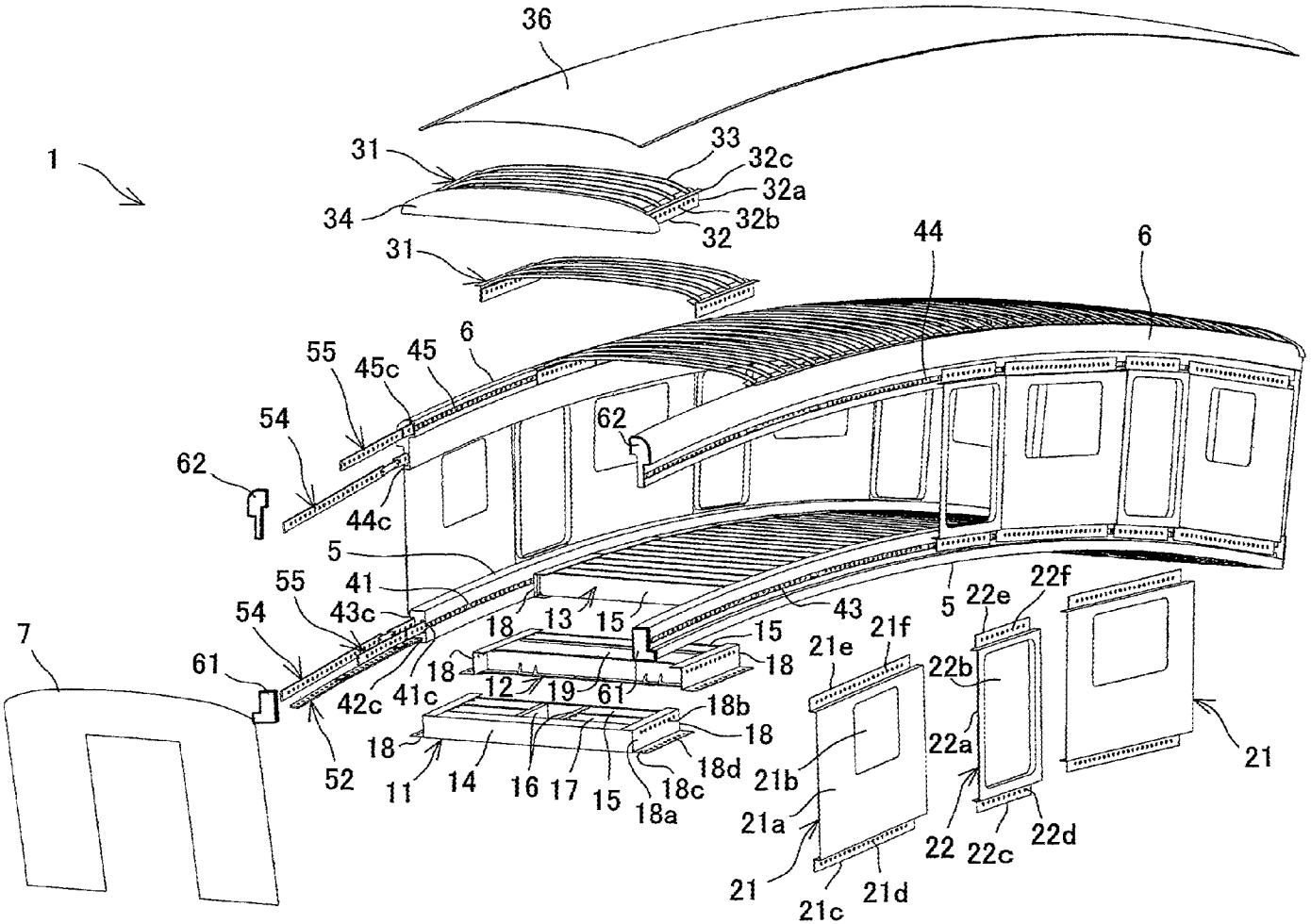
FIG. 2 is an exploded perspective view showing the railcar bodyshell of FIG. 1.
Figure 3:
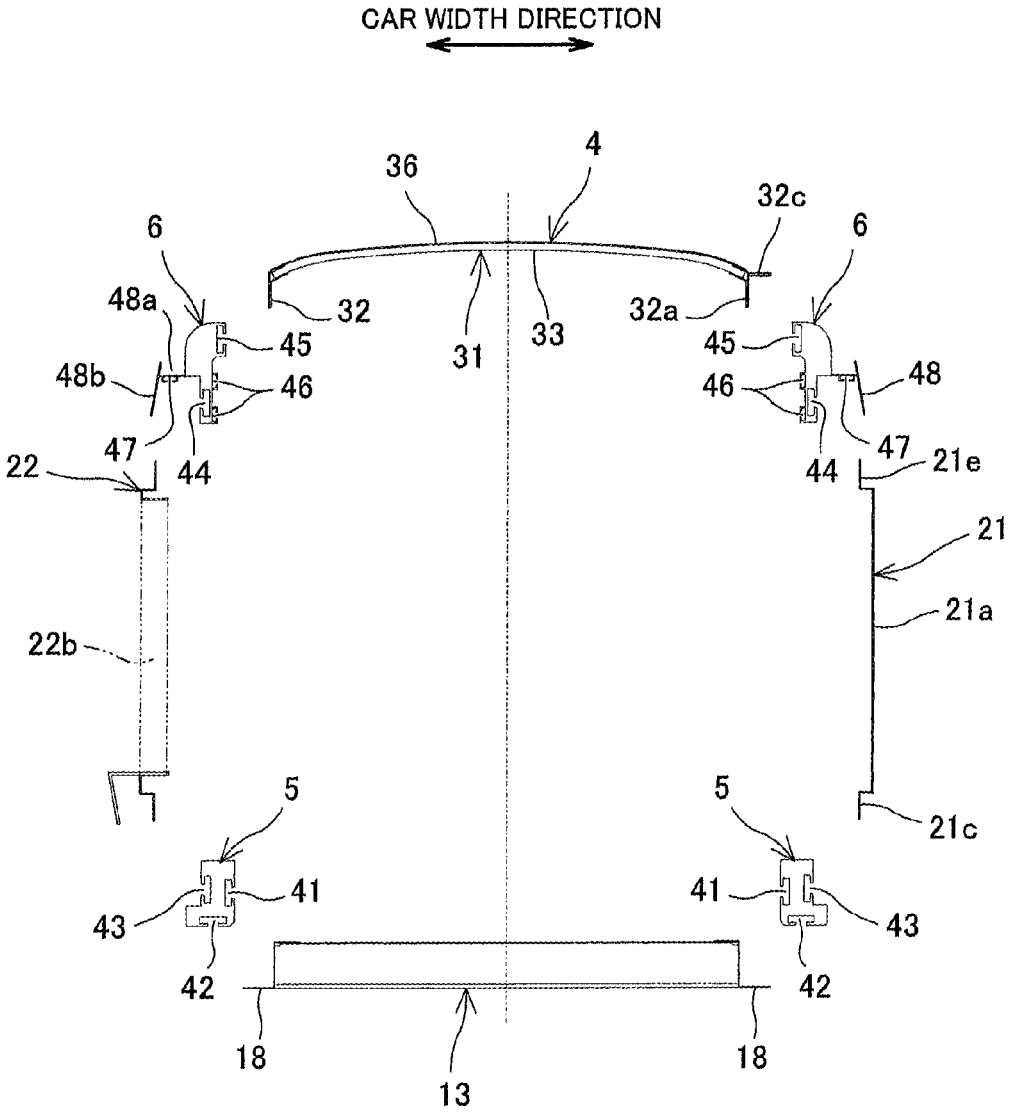
FIG. 3 is an exploded longitudinal sectional view showing the railcar bodyshell of FIG. 1. A right half of FIG. 3 is a diagram showing a cross section of a first side module, and a left half of FIG. 3 is a diagram showing a cross section of a second side module.
Figure 4:
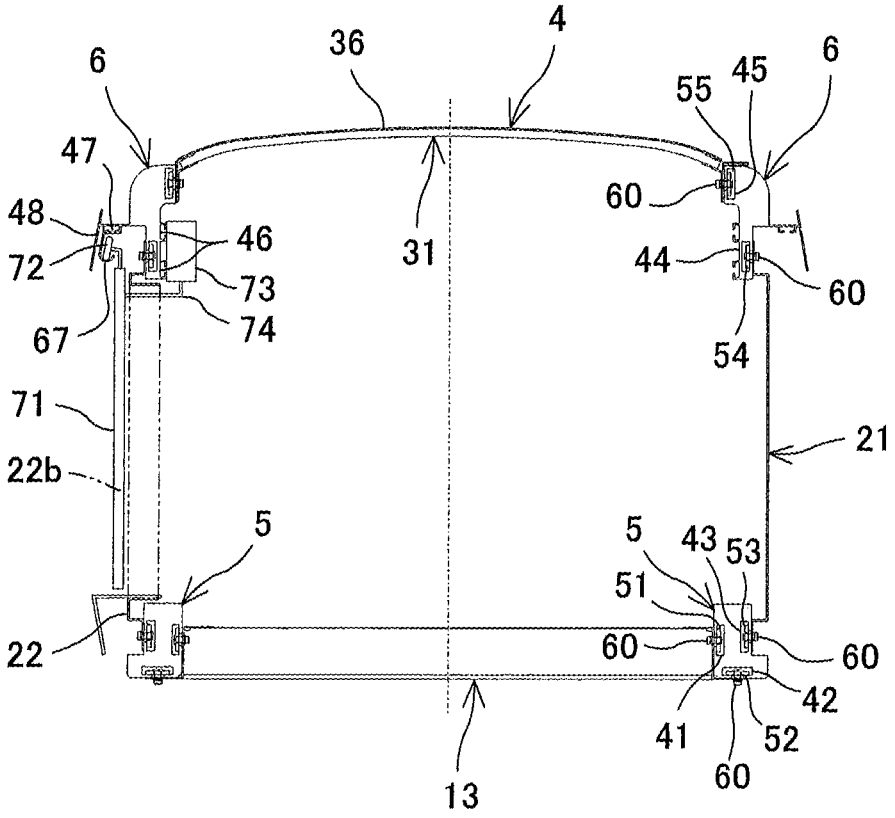
FIG. 4 is a longitudinal sectional view showing the assembled railcar bodyshell of FIG. 3.

FIG. 1 is a perspective view showing a railcar bodyshell according to the first embodiment. FIG. 2 is an exploded perspective view showing the railcar bodyshell 1 of FIG. 1. FIG. 3 is an exploded longitudinal sectional view showing the railcar bodyshell 1 of FIG. 1. A right half of FIG. 3 is a diagram showing a cross section of a first side module 21, and a left half of FIG. 3 is a diagram showing a cross section of a second side module 22. FIG. 4 is a longitudinal sectional view showing the assembled railcar bodyshell 1 of FIG. 3. As shown in FIGS. 1 and 2, the railcar bodyshell 1 includes a floor portion 2, side portions 3, a roof portion 4, side sills 5 each interposed between the floor portion 2 and the side portion 3, cantrails 6 each interposed between the side portion 3 and the roof portion 4, and end portions 7 provided at respective car longitudinal direction end portions of the bodyshell 1.

The floor portion 2 includes a plurality of floor modules 11 to 13 into which the floor portion 2 of the bodyshell 1 is divided in a car longitudinal direction. Regarding the floor modules 11 to 13, the first floor modules 11 are floor modules arranged at the respective car longitudinal direction end portions of the bodyshell 1. Each of the first floor modules 11 includes: an end beam 14 arranged at the car longitudinal direction end portion and extending in a car width direction; a floor receiving beam 15 arranged at a car longitudinal direction inner side of the end beam 14; a pair of center sills 16 extending in the car longitudinal direction so as to couple the end beam 14 and the floor receiving beam 15; floor receiving beams 17 extending from the respective center sills 16 toward a car width direction outer side; and attachment plates 18 connected to car width direction end portions of the end beam 14 and floor receiving beams 15 and 17 and extending in the car longitudinal direction. Each of the attachment plates 18 includes at least a side plate portion 18*a* and a bottom plate portion 18*c* projecting from a lower end portion of the side plate portion 18*a* toward a car width direction outer side. The side plate portion 18*a* is provided with a plurality of fastening holes 18*b* arranged so as to be spaced apart from one another in the car longitudinal direction, and the bottom plate portion 18*c* is provided with a plurality of fastening holes 18*d* arranged so as to be spaced apart from one another in the car longitudinal direction. The fastening holes 18*b* are linearly lined up in a line in the car longitudinal direction on the side plate portion 18*a*, and the fastening holes 18*d* are linearly lined up in a line in the car longitudinal direction on the bottom plate portion 18*c*.

Each of the second floor modules 12 is arranged adjacent to the first floor module 11 at a car longitudinal direction inner side of the first floor module 11. The second floor module 12 includes: a bolster beam 19 arranged so as to oppose to the first floor module 11, a bogie (not shown) being attached to the bolster beam 19; the floor receiving beam 15 arranged at the car longitudinal direction inner side of the bolster beam 19; and the attachment plates 18 connected to car width direction end portions of the bolster beam 19 and floor receiving beam 15 and extending in the car longitudinal direction. A plurality of third floor modules 13 are arranged in an intermediate region so as to be lined up in the car longitudinal direction. The intermediate region is located between the second floor module 12 arranged at one of car longitudinal direction sides of the bodyshell 1 and the second floor module 12 arranged at the other car longitudinal direction side of the bodyshell 1. Each of the third floor modules 13 includes: a plurality of floor receiving beams 15 arranged so as to be spaced apart from one another in the car longitudinal direction; and the attachment plates 18 connected to car width direction end portions of the floor receiving beams 15 and extending in the car longitudinal direction. For example, in the present embodiment, the number of floor modules 11 to 13 is larger than the number of below-described side modules 21 and 22. However, the present embodiment is not limited to this.

Each of the side portions 3 includes a plurality of side modules 21 and 22 into which the side portion 3 of the bodyshell 1 is divided in the car longitudinal direction. Each of the first side modules 21 includes a side outside plate 21*a* provided with at least one window opening 21*b*. The second side module 22 includes a side outside plate 22*a* provided with only one door opening 22*b*. To be specific, the side modules 21 and the side modules 22 are obtained by dividing at least the side bodyshell in the car longitudinal direction into the modules each not including the door opening and the modules each including the door opening. In the present embodiment, the first side modules 21 and the second side modules 22 are alternately lined up in the car longitudinal direction. An attaching portion 21*c* is provided at a lower end portion of the side outside plate 21*a* via a step. The attaching portion 21*c* is located at a car width direction inner side of the side outside plate 21 a and extends in the car longitudinal direction. An attaching portion 22*c* is provided at a lower end portion of the side outside plate 22*a* via a step. The attaching portion 22*c* is located at the car width direction inner side of the side outside plate 22*a* and extends in the car longitudinal direction. An attaching portion 21*e* is provided at an upper end portion of the side outside plate 21*a* via a step. The attaching portion 21*e* is located at the car width direction inner side of the side outside plate 21 a and extends in the car longitudinal direction. An attaching portion 22*e* is provided at an upper end portion of the side outside plate 22*a* via a step. The attaching portion 22*e* is located at the car width direction inner side of the side outside plate 22*a* and extends in the car longitudinal direction. The attaching portions 21*c* and 21*e* are formed integrally with the side outside plate 21*a*, and the attaching portions 22*c* and 22*e* are formed integrally with the side outside plate 22*a*. A plurality of fastening holes 21*d* arranged so as to be spaced apart from one another in the car longitudinal direction are formed at the attaching portion 21*c*. A plurality of fastening holes 21*f* arranged so as to be spaced apart from one another in the car longitudinal direction are formed at the attaching portion 21*e*. A plurality of fastening holes 22*d* arranged so as to be spaced apart from one another in the car longitudinal direction are formed at the attaching portion 22*c*. A plurality of fastening holes 22*f* arranged so as to be spaced apart from one another in the car longitudinal direction are formed at the attaching portion 22*e*. The fastening holes 21*d* are linearly lined up in a line in the car longitudinal direction on the attaching portion 21*c*. The fastening holes 21*f* are linearly lined up in a line in the car longitudinal direction on the attaching portion 21*e*. The fastening holes 22*d* are linearly lined up in a line in the car longitudinal direction on the attaching portion 22*c*. The fastening holes 22*f* are linearly lined up in a line in the car longitudinal direction on the attaching portion 22*e*.

The roof portion 4 includes a roof plate 36 and a plurality of roof modules 31 connected to a lower surface of the roof plate 36 and lined up in the car longitudinal direction. To be specific, the roof plate 36 is a single plate continuously formed from one of the car longitudinal direction sides of the bodyshell 1 to the other side. The plurality of roof modules 31 are formed by dividing a portion of the roof portion 4 in the car longitudinal direction, the portion being connected to the roof plate 36. Each of the roof modules 31 includes: a plurality of canines 33 spaced apart from one another in the car longitudinal direction and extending in the car width direction; and attachment plates 32 each connected to car width direction end portions of the canines 33 and extending in the car longitudinal direction. Each of the attachment plates 32 includes at least a side plate portion 32*a* and an upper plate portion 32*c* projecting from an upper end portion of the side plate portion 32*a* toward the car width direction outer side. The side plate portions 32*a* is provided with a plurality of fastening holes 32*b* arranged so as to be spaced apart from one another in the car longitudinal direction. The fastening holes 32*b* are linearly lined up in a line in the car longitudinal direction on the side plate portion 32*a*. The upper plate portion 32*c* is placed on the cantrail 6 to position the roof module 31 relative to the cantrail 6 in a vertical direction. An end plate 34 to which the end portion 7 is joined is provided at a car longitudinal direction end portion of the roof module 31 arranged at the car longitudinal direction end portion. In the present embodiment, the number of roof modules 31 is larger than the number of side modules 21 and 22. However, the present embodiment is not limited to this.

Each of the side sills 5 is an elongated member integrally extending from one of the car longitudinal direction sides of the bodyshell 1 to the other side. End portions of the floor modules 11 to 13 and end portions of the side modules 21 and 22 are attached to the side sill 5. The side sill 5 is longer in the car longitudinal direction than each of the modules 11 to 13, 21, and 22. A plurality of modules 11 to 13, 21, and 22 are attached to one side sill 5. The side sill 5 includes: a first groove portion 41 formed on a car width direction inner side surface; a second groove portion 42 formed on a bottom surface; and a third groove portion 43 formed on a car width direction outer side surface. The first groove portion 41 and the second groove portion 42 are groove portions used to fix the floor modules 11 to 13, and the third groove portion 43 is a groove portion used to fix the side modules 21 and 22, the groove portions extending in the car longitudinal direction. In a side view, the side sill 5 has a circular-arc shape that is convex upward. To be specific, since a car longitudinal direction middle portion of the assembled bodyshell 1 bends downward by the weight of the bodyshell 1, the side sill 5 has camber. Therefore, each of the first to third groove portions 41 to 43 also has a circular-arc shape that is convex upward. Specifically, the side sill 5 is formed by extruding metal, such as aluminum, and then bending the metal.

First to third coupling seat units 51 to 53 are inserted into internal spaces of the first to third groove portions 41 to 43, respectively. The side plate portions 18*a* of the floor modules 11 to 13 are fastened to the first coupling seat units 51 by fastening members 60, and the bottom plate portions 18*c* of the floor modules 11 to 13 are fastened to the second coupling seat units 52 by the fastening members 60. With this, the floor modules 11 to 13 are fixed to the side sills 5. The attaching portions 21*c* of the side modules 21 and 22 are fastened to the third coupling seat unit 53 by the fastening members 60. With this, lower end portions of the side modules 21 and 22 are fixed to the side sill 5. End opening portions 41*c*, 42*c*, and 43*c* which open in the car longitudinal direction are formed at both car longitudinal direction ends of the first to third groove portions 41, 42, and 43, respectively. The coupling seat units 51 to 53 are inserted through the end opening portions 41*c*, 42*c*, and 43*c* into the internal spaces of the groove portions 41 to 43, respectively. A lid member 61 is attached to a car longitudinal direction end portion of the side sill 5 so as to close the end opening portions 41*c*, 42*c*, and 43*c*.

Each of the cantrails 6 is an elongated member integrally extending from one of the car longitudinal direction sides of the bodyshell 1 to the other side. End portions of the side modules 21 and 22 and end portions of the roof modules 31 are attached to the cantrail 6. The cantrail 6 is longer in the car longitudinal direction than each of the modules 21, 22, and 31. A plurality of modules 21, 22, and 31 are attached to one cantrail 6. The cantrail 6 includes: a first groove portion 44 formed on a car width direction outer side surface; a second groove portion 45 formed at an upper portion of a car width direction inner side surface; and a pair of upper and lower third groove portions 46 formed at a lower portion of the car width direction inner side surface (the third groove portions 46 are shown in FIGS. 3 and 4 but are not shown in FIG. 2). The cantrail 6 includes an eaves portion 48 projecting toward a car width direction outer side. The eaves portion 48 includes: a lateral plate portion 48*a* projecting in a lateral direction toward the car width direction outer side; and a vertical plate portion 48*b* projecting downward from the lateral plate portion 48*a*. An upper end of the vertical plate portion 48*b* projects above the lateral plate portion 48*a*. With this, an upper side of the lateral plate portion 48*a* serves as a rain gutter. A fourth groove portion 47 is formed on a lower surface of the lateral plate portion 48*a*. As with the side sill 5, the cantrail 6 has a circular-arc shape that is convex upward in a side view, that is, the cantrail 6 has camber. Therefore, each of the first to fourth groove portions 44 to 47 also has a circular-arc shape that is convex upward in a side view. Specifically, the cantrail 6 is formed by extruding aluminum or the like and then bending the aluminum or the like. Because of the above camber, the cantrail 6 is longer in the car longitudinal direction than the side sill 5.

The first and second groove portions 44 and 45 are groove portions used to fix the side modules 21 and 22 and the roof modules 31, the groove portions extending in the car longitudinal direction. The third groove portion 46 is a groove portion used to attach devices (such as a door opening/closing unit 73), the groove portion extending in the car longitudinal direction. The fourth groove portion 47 is a groove portion used to attach a door guide 67, the groove portion extending in the car longitudinal direction. Each of these groove portions 44 to 47 is formed from one of car longitudinal direction ends of the side sill 5 to the other end. A guided member 72 (such as a roller) is placed on the door guide 67 and is connected to an upper end of a door 71 which opens and closes the door opening 22*b*. To be specific, the door 71 of the present embodiment is an externally suspended type. A drive bracket 74 of the door opening/closing unit 73 is connected to the door 71. When the door opening/closing unit 73 causes the drive bracket 74 to reciprocate in the car longitudinal direction, the door 71 opens or closes. The eaves portion 48 is formed from one of the car longitudinal direction ends of the side sill 5 to the other end. Therefore, when viewed from a car width direction outer side, the eaves portion 48 covers not only the door guide 67 but also the first groove portion 44.

Fourth and fifth coupling seat units 54 and 55 are inserted into internal spaces of the first and second groove portions 44 and 45, respectively (although coupling seat units are also inserted into the third and fourth groove portions 46 and 47, they are not shown). The attaching portions 21*e* and 22*e* of the side modules 21 and 22 are fastened to the fourth coupling seat unit 54 by the fastening members 60. With this, the side modules 21 and 22 are fixed to the cantrail 6. The side plate portions 32*a* of the roof modules 31 are fastened to the fifth coupling seat unit 55 by the fastening members 60. With this, the roof modules 31 are fixed to the cantrail 6. End opening portions 44*c* and 45*c* which open in the car longitudinal direction are formed at both car longitudinal direction ends of the first and second groove portions 44 and 45, respectively. The coupling seat units 54 and 55 are inserted through the end opening portion 44*c* and 45*c* into the internal spaces of the groove portions 44 and 45, respectively. A lid member 62 is attached to a car longitudinal direction end portion of the cantrail 6 so as to close the end opening portions 44*c* and 45*c* (although not shown, the end opening portions of the third and fourth groove portions 46 and 47 are also closed by the lid member 62).

Figure 5:
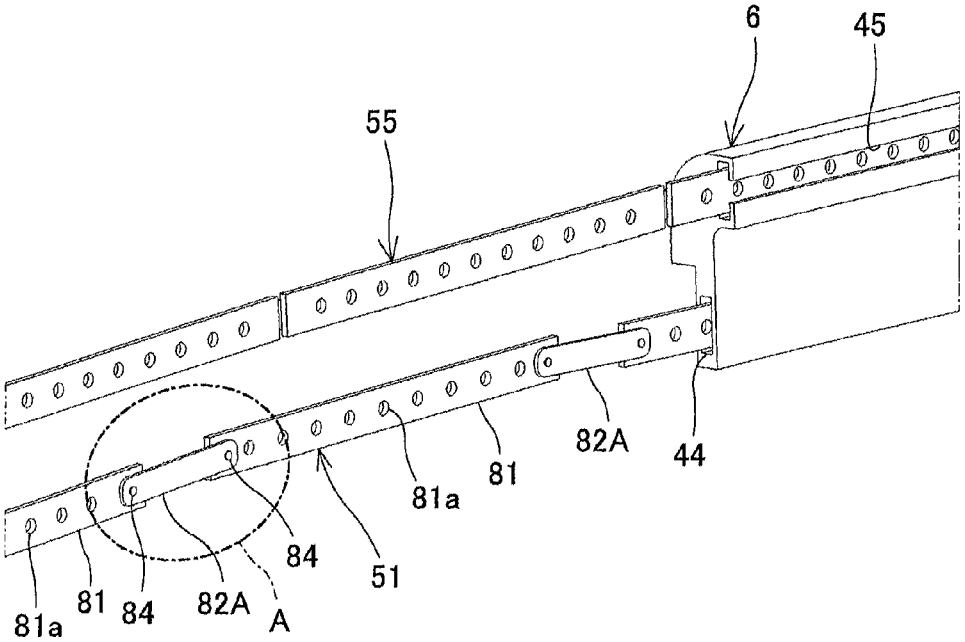
FIG. 5 is an exploded perspective view showing a side sill, cantrail, and coupling seat units of the railcar bodyshell of FIG. 2.
Figure 5:
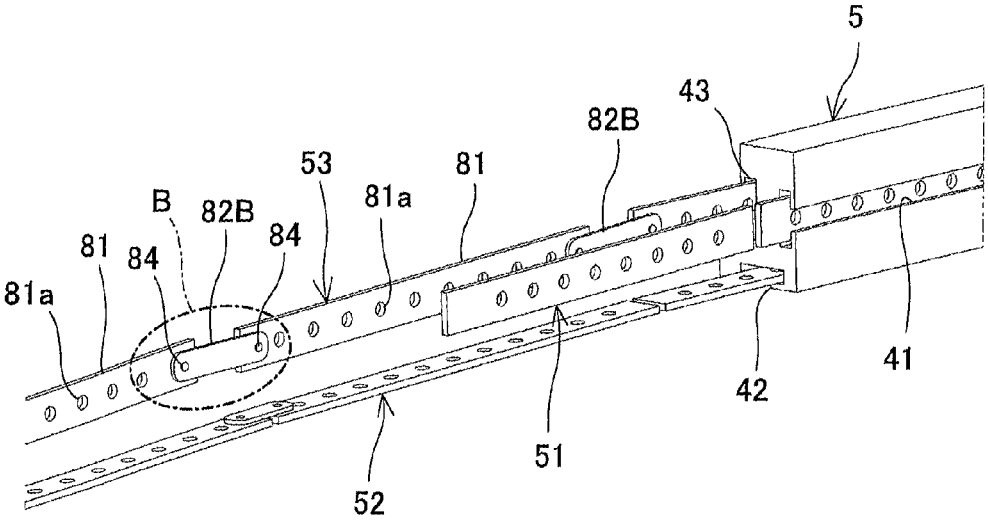

FIG. 5 is an exploded perspective view showing the side sill 5, cantrail 6, and coupling seat units 51 to 55 of the railcar bodyshell 1 of FIG. 2. As shown in FIG. 5, the first to fifth coupling seat units 51 to 55 are inserted into the internal spaces of the first to third groove portions 41 to 43 of the side sill 5 and the internal spaces of the first and second groove portions 44 and 45 of the cantrail 6, respectively (although not shown, the coupling seat units are also inserted into the respective third and fourth groove portions 46 and 47 of the cantrail 6). Each of the coupling seat units 51 to 55 is configured such that a plurality of coupling seats are lined up in the car longitudinal direction, each of the coupling seats including a plurality of fastening holes linearly arranged in a line in the car longitudinal direction.

The third coupling seat unit 53 which fixes the side modules 21 and 22 includes: a plurality of coupling seats 81 to which the side modules 21 and 22 are fixed; and coupling links 82B each coupling the coupling seats 81 to each other. The fourth coupling seat unit 54 which fixes the side modules 21 and 22 includes: a plurality of coupling seats 81 to which the side modules 21 and 22 are fixed; and coupling links 82A each coupling the coupling seats 81 to each other. Each of the coupling seats 81 is rotatably coupled to the coupling link 82A or 82B by a coupling pin 84. The coupling seat 81 is an elongated plate having a strip shape and includes a plurality of fastening holes 81*a* linearly lined up in a line in the car longitudinal direction. The coupling links 82A and 82B are arranged at positions corresponding to car longitudinal direction end portions of the side modules 21 and 22 (see FIG. 1) in the car longitudinal direction. To be specific, the coupling link 82A is arranged so as to correspond to a region between the attaching portions 21*e* and 22*e* of the side modules 21 and 22 adjacent to each other in the car longitudinal direction, and the coupling link 82B is arranged so as to correspond to a region between the attaching portions 21*f* and 22*f* of the side modules 21 and 22 adjacent to each other in the car longitudinal direction.

Figure 6A:
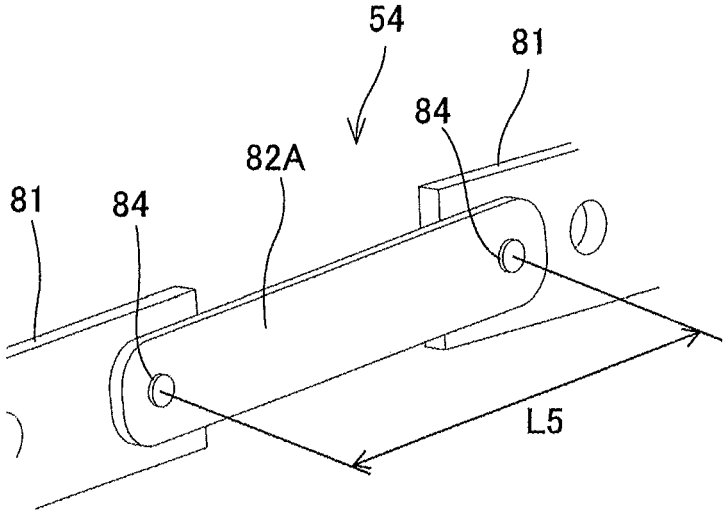
FIG. 6A is an enlarged major portion perspective view showing a portion A of FIG. 5.
Figure 6B:
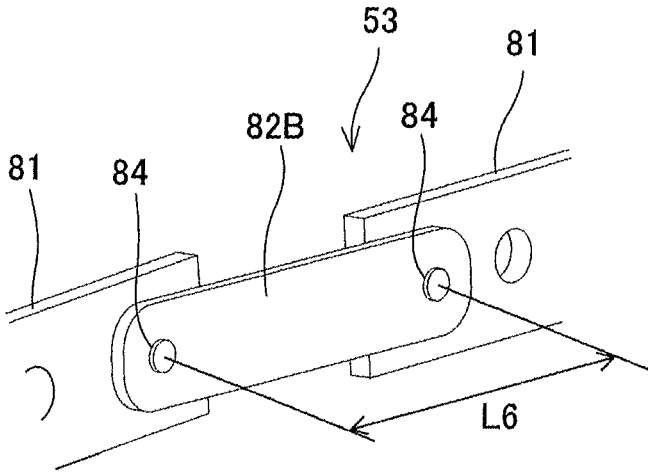
FIG. 6B is an enlarged major portion perspective view showing a portion B of FIG. 5.

FIG. 6A is an enlarged major portion perspective view showing a portion A of FIG. 5. FIG. 6B is an enlarged major portion perspective view showing a portion B of FIG. 5. As shown in FIGS. 6A and 6B, the coupling link 82A of the fourth coupling seat unit 54 inserted into the internal space of the first groove portion 44 of the cantrail 6 is longer in the car longitudinal direction than the coupling link 82B of the third coupling seat unit 53 inserted into the internal space of the third groove portion 43 of the side sill 5. With this, a length L5 between the coupling pins 84 located at both sides of the coupling link 82A is longer than a length L6 between the coupling pins 84 located at both sides of the coupling link 82B. To be specific, a gap between the adjacent coupling seats 81 of the fourth coupling seat unit 54 is larger in the car longitudinal direction than a gap between the adjacent coupling seats 81 of the third coupling seat unit 53. Since the coupling seat 81 of the fourth coupling seat unit 54 and the coupling seat 81 of the third coupling seat unit 53 are the same in length as each other in the car longitudinal direction, a car longitudinal direction length of the fourth coupling seat unit 54 for the cantrail 6 is longer than a car longitudinal direction length of the third coupling seat unit 53 for the side sill 5.

Figure 7:
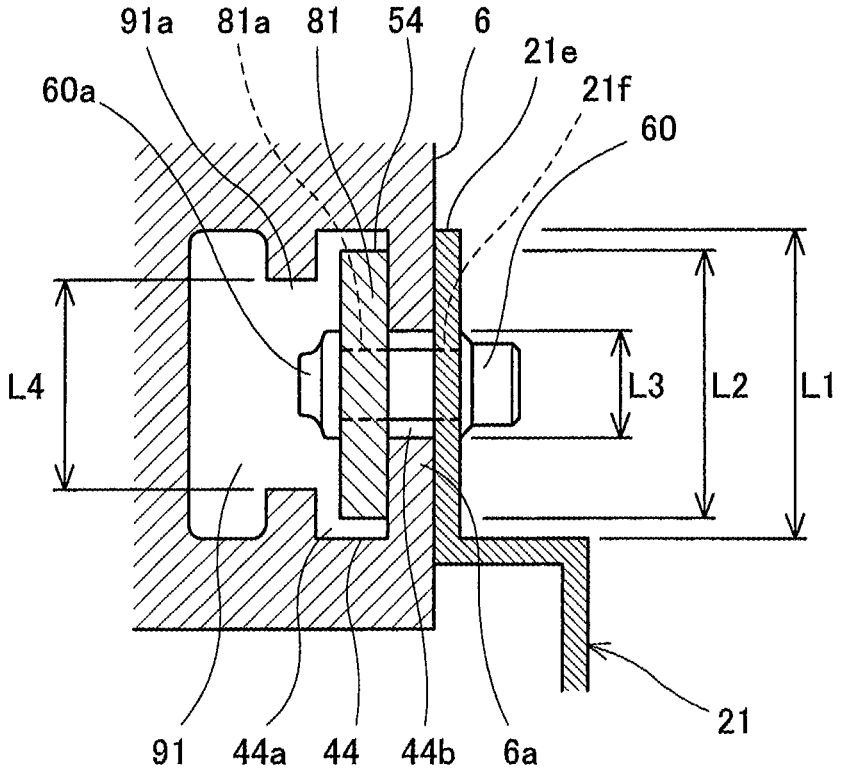
FIG. 7 is an enlarged cross-sectional view showing major portions of the railcar bodyshell of FIG. 4.

FIG. 7 is an enlarged cross-sectional view showing major portions of the railcar bodyshell 1 of FIG. 4. FIGS. 2 to 5 schematically show the shapes of the groove portions 41 to 45. Among these groove portions 41 to 45, the first groove portion 44 of the cantrail 6 will be more specifically explained in reference to FIG. 7. As shown in FIG. 7, the first groove portion 44 includes: an internal space 44*a* into which the fourth coupling seat unit 54 is inserted; and a slit-shaped longitudinal opening portion 44*b* extending in the car longitudinal direction of the first groove portion 44 so as to open toward the side module 21. A width L3 of the longitudinal opening portion 44*b* is smaller than each of a width L1 of the internal space 44*a* of the first groove portion 44 and a width L2 of the fourth coupling seat unit 54 in a direction (upper/lower direction in FIG. 7) perpendicular to the car longitudinal direction. The width L2 of the fourth coupling seat unit 54 is smaller than the width L1 of the internal space 44*a* of the first groove portion 44. With this, the cantrail 6 is provided with a pair of edge portions 6*a*. The pair of edge portions 6*a* are located at both respective width direction (upper/lower direction in FIG. 7) sides of the longitudinal opening portion 44*b* and interposed between the attaching portion 21*e* of the side module 21 and the coupling seat 81 of the fourth coupling seat unit 54.

The side modules 21 are fixed to the coupling seats 81 of the coupling seat unit 54 by the fastening members 60 through the longitudinal opening portion 44*b*. Specifically, the fastening holes 21*f* of the attaching portions 21*e* of the side modules 21 and the fastening holes 81*a* of the coupling seats 81 are positioned, and the fastening members 60 are fastened to the fastening holes 21*f* and 81*a* through the longitudinal opening portion 44*b*. With this, the edge portions 6*a* opposing to each other in the upper/lower direction are pressurized and sandwiched by the attaching portion 21*e* and the coupling seat 81. Thus, the side modules 21 are fixed to the cantrail 6. The width L3 of the longitudinal opening portion 44*b* of the first groove portion 44 is larger than an outer diameter of a portion of the fastening member 60, the portion being located at the longitudinal opening portion 44*b*. Therefore, even in a case where the rows of the fastening holes 21*f* of the side modules 21 and 22 are linear, and the longitudinal opening portion 44*b* has a circular-arc shape, the fixation by the fastening members 60 is easily performed. Each of the side modules 21 and the coupling seats 81 is made of a metal material that is harder than the cantrail 6. For example, each of the side modules 21 and the coupling seats 81 is made of iron, stainless steel, or the like, and the cantrail 6 is made of aluminum or the like. Used as the fastening member 60 is a bolt or a rivet. For example, a blind bolt or a blind rivet may be used, which can be attached by one-way work only from the outside of the groove portion.

A recess 91 is formed on a surface of the first groove portion 44, the surface being opposite to the longitudinal opening portion 44*b*. The recess 91 opposes to a tip end portion 60*a* of the fastening member 60, the tip end portion 60*a* projecting from the coupling seat 81. A width L4 of an opening portion 91*a* of the recess 91 is smaller than the width L2 of the coupling seat 81 and larger than the outer diameter of the fastening member 60, the opening portion 91*a* communicating with the internal space 44*a*. In a state where the fastening member 60 is fastened to the coupling seat 81, the tip end portion 60*a* of the fastening member 60 is located at the recess 91. FIG. 7 especially shows the fixation between the side module 21 and the cantrail 6 in detail. The same is true for the fixation between each of the module 11 to 13, 22, and 31 and the side sill 5 or the cantrail 6.

As shown in FIGS. 1 and 2, the side modules 21 and 22 attached to the side sill 5 and the cantrail 6 as above are lined up in the car longitudinal direction. The car longitudinal direction end portions of the side outside plates 21*a* and 22*a* overlap each other and are joined to each other by spot welding or the like at the overlapping portions. At this time, the side modules 21 and 22 are arranged while changing the postures of the side modules 21 and 22 such that the side modules 21 and 22 as a whole have a circular-arc shape that is convex upward. With this, without giving the camber to each of the shapes of the modules 21 and 22, the camber is realized as a whole.

According to the above configuration, since the groove portions 41 to 45 of the side sill 5 and the cantrail 6 extend in the car longitudinal direction, the modules 11 to 13, 21, 22, and 31 are easily positioned relative to the side sill 5 and the cantrail 6 in the direction perpendicular to the car longitudinal direction, and the modules 11 to 13, 21, 22, and 31 can be easily fixed to the side sill 5 and the cantrail 6 with a high degree of accuracy. Further, the modules 21 are fixed through the longitudinal opening portion 44*b* to the coupling seat unit 54 inserted into the internal space 44*a* of the groove portion 44. Therefore, positional relations among the side sill 5, the cantrail 6, and the modules 11 to 13, 21, 22, and 31 can be easily adjusted, and the positioning can be easily performed even though the camber exists.

Each of the coupling seat units 51 to 55 includes: a plurality of coupling seats 81; and coupling links 82A or 82B each rotatably coupling the coupling seat 81 to each other. Therefore, as compared to a case where a single considerably long coupling seat is used, the coupling seat 81 is easily handled, and an angle of a coupling portion between the coupling seat 81 and the coupling link 82A or 82B can be easily adjusted such that the coupling portion extends along the camber. Since the coupling seats 81 are coupled to one another by the coupling links 82A or 82B, the car longitudinal direction positions of the fastening holes 81*a* of each of the coupling seat units 51 to 55 are determined as a whole. Therefore, the positioning of the modules 11 to 13, 21, 22, and 31 relative to the fastening holes 81*a* can be easily performed. Before the assembly, the row of the fastening holes 81*a* of each of the coupling seats 81 is linear, and the rows of the fastening holes 18*b*, 18*d*, 21*d*, 21*f*, 22*d*, 22*f*, and 32*b* of the modules 11 to 13, 21, 22, and 31 are also linear. Therefore, as compared to a case where the row of the fastening holes has a circular-arc shape in accordance with the camber, a machining device which forms the fastening holes can be generalized, and relative positional accuracy between the fastening holes 18*b*, 18*d*, 21*d*, 21*f*, 22*d*, 22*f*, and 32*b* and the fastening holes 81*a* improves.

The coupling link 82A arranged at the first groove portion 44 of the cantrail 6 is longer in the car longitudinal direction than the coupling link 82B arranged at the third groove portion 43 of the side sill 5. Therefore, even in a case where the cantrail 6 at the upper side becomes longer in the car longitudinal direction than the side sill 5 at the lower side by the camber, the coupling seats 81 can be easily arranged along the camber while the lengths of the coupling seats 81 are set to be equal to one another, and the coupling seats 81 can be commonalized as parts.

The end opening portions 41*c*, 42*c*, 43*c*, 44*c*, and 45*c* which open in the car longitudinal direction are formed at both car longitudinal direction ends of the first to third groove portions 41 to 43 of the side sill 5 and both car longitudinal direction ends of the first to fourth groove portions 44 to 47 of the cantrail 6, and the side sill 5 and the cantrail 6 can be easily produced by the extrusion. The lid member 61 which closes the end opening portions 41*c*, 42*c*, and 43*c*, is fixed to the side sill 5, and the lid member 62 which closes the end opening portions 44*c* and 45*c* is fixed to the cantrail 6. Therefore, the coupling seat units 51 to 55 inserted into the groove portions 41 to 47 are prevented from falling down from the groove portion 41 to 47, so that the handling can be facilitated.

The recess 91 is formed on a surface of the inner surface of the groove portion 44, the surface opposing to the tip end portion 60*a* of the fastening member 60, the tip end portion 60*a* projecting from the coupling seat 81. Therefore, while stably holding the coupling seats 81 in the groove portion 44, for example, the tip end portion 60*a* of the fastening member 60 can be prevented from interfering with the inner surface of the groove portion 44. The cantrail 6 includes the third groove portions 46 for attaching the door opening/closing unit 73, the third groove portions 46 extending in the car longitudinal direction. The door opening/closing unit 73 is attached to the groove portions 46. Therefore, the unit 73 can be easily positioned relative to the cantrail 6. Thus, the door opening/closing unit 73 can be easily fixed to the cantrail 6 with a high degree of accuracy.

Second Embodiment

Figure 8:
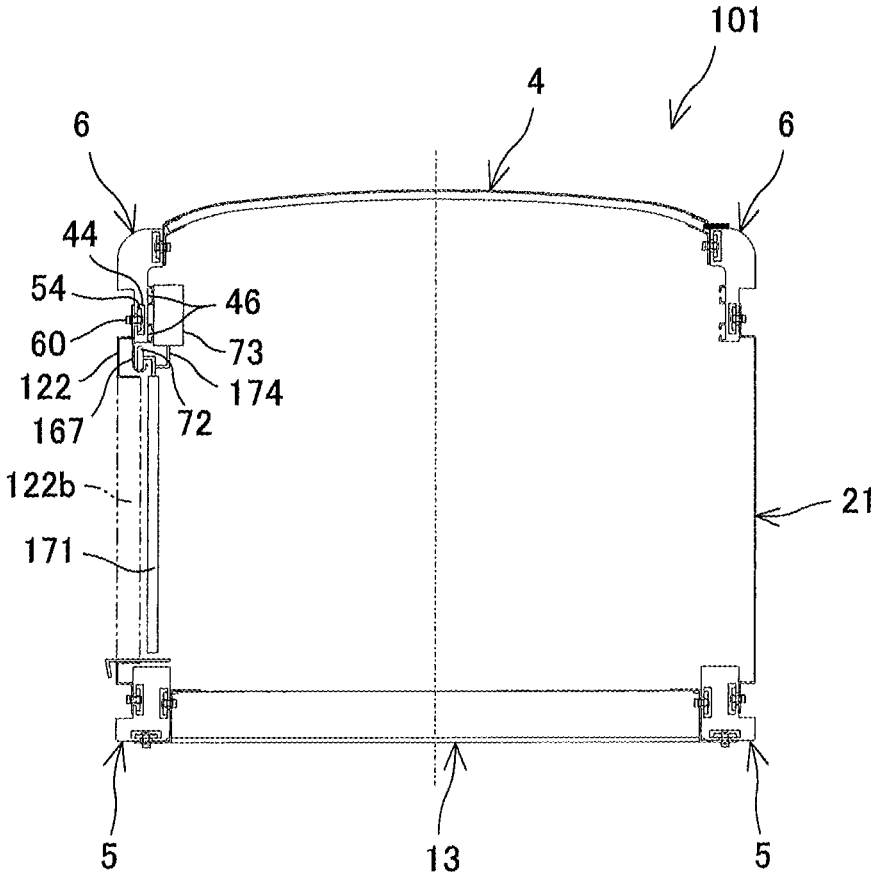
FIG. 8 is a diagram showing the railcar bodyshell according to a second embodiment and corresponds to FIG. 4.

FIG. 8 is a diagram showing a railcar bodyshell 101 according to the second embodiment and corresponds to FIG. 4. As shown in FIG. 8, the bodyshell 101 of the present embodiment includes a door 171 of a door pocket type. Specifically, a door guide 167 and a side module 122 including a door opening 122*b* are fastened to the coupling seat unit 54 by the fastening members 60, the coupling seat unit 54 being inserted into the internal space of the groove portion 44 of the cantrail 6. The door guide 167 and the door 171 are arranged at a car width direction inner side of the side module 122. The guided member 72 (such as a roller) is placed on the door guide 167 and is connected to an upper end of the door 171 which opens and closes the door opening 122*b*. A drive bracket 174 of the door opening/closing unit 73 is connected to the door 171. When the door opening/closing unit 73 causes the drive bracket 174 to reciprocate in the car longitudinal direction, the door 171 opens or closes. Since the other components are the same as those in the first embodiment, detailed explanations thereof are omitted.

The present invention is not limited to the above embodiments, and modifications, additions, and eliminations may be made within the scope of the present invention. The above embodiments may be combined arbitrarily. For example, a part of components or methods in one embodiment may be applied to another embodiment. The coupling seat unit may be a single elongated coupling seat which does not include the coupling link. The coupling seat unit does not have to extend in the car longitudinal direction and may be a washer or the like. In the above embodiments, each of the floor portion 2, the side portion 3, and the roof portion 4 is modularized. However, at least the side portion 3 may be modularized, and the floor portion 2 and/or the roof portion 4 may not be modularized. Each module may be joined to the coupling seat unit by welding (Friction Stir Welding (FSW), Friction Spot Joining (FSJ), etc.) instead of the fastening members 60. Instead of using the coupling seat unit, the module may be configured such that: a guide projects from the module; the guide is slidingly inserted into the groove portion of the side sill or the groove portion of the cantrail; and the module is welded to the side sill or the cantrail.

INDUSTRIAL APPLICABILITY

As above, the railcar bodyshell according to the present invention has the above-described excellent effects. It is useful to widely apply the present invention to railcars which can achieve the significance of these effects.

REFERENCE SIGNS LIST

1 railcar bodyshell
2 floor portion
3 side portion
4 roof portion
5 side sill (elongated member)
6 cantrail (elongated member)
11 to 13 floor module
21, 22 side module
31 roof module
41 to 47 groove portion
41*c*, 42*c*, 43*c*, 44*c*, 45*c* end opening portion

44*a* internal space
44*b* longitudinal opening portion
51 to 55 coupling seat unit
60 fastening member
61, 62 lid member
81 coupling seat
82A, 82B coupling link
91 recess

The invention claimed is:

1. A railcar bodyshell comprising:

a plurality of modules into which at least one of a floor portion, side portion, or roof portion of the bodyshell is divided in a car longitudinal direction;

an elongated member extending in the car longitudinal direction, the plurality of modules being attached to the elongated member; and a coupling seat unit inserted into an internal space of a groove portion of the elongated member, the elongated member including the groove portion for fixing the plurality of modules to the elongated member, the groove portion extending in the car longitudinal direction, and the plurality of modules being fixed to the coupling seat unit through a longitudinal opening portion of the groove portion.

2. The railcar bodyshell according to claim 1, wherein:

a width of the longitudinal opening portion of the groove portion is smaller than each of a width of the internal space of the groove portion and a width of the coupling seat unit in a direction perpendicular to the car longitudinal direction, the longitudinal opening portion extending in the car longitudinal direction.

3. The railcar bodyshell according to claim 2, wherein:

the coupling seat unit includes (a) a plurality of coupling seats to which the respective modules are fixed, and (b) coupling links rotatably coupling the plurality of coupling seats to one another; and the coupling links are arranged at positions corresponding to car longitudinal direction end portions of the modules in the car longitudinal direction.

4. The railcar bodyshell according to claim 3, wherein:

the side portion is constituted by the plurality of modules;

each of a side sill and a cantrail is constituted by the elongated member;

the coupling link arranged at the groove portion of the cantrail is longer in the car longitudinal direction than the coupling link arranged at the groove portion of the side sill.

5. The railcar bodyshell according to claim 2, wherein:

end opening portions are formed at both respective car longitudinal direction ends of the groove portion, the end opening portions being open in the car longitudinal direction; and lid members are attached to the respective end opening portions.

6. The railcar bodyshell according to claim 2, wherein:

the plurality of modules are fastened to the coupling seat unit by fastening members; and a recess is formed on a surface of the groove portion, the surface being opposite to the longitudinal opening portion, the recess opposing to a portion of the fastening member, the portion projecting from the coupling seat unit.

7. The railcar bodyshell according to claim 1, wherein the elongated member includes another groove portion for attaching a device to the elongated member, the another groove portion extending in the car longitudinal direction.

8. The railcar bodyshell according to claim 1, wherein the coupling seat is movable relative to the elongated member.

* * * * *